United States Patent [19]

Gittins

[11] Patent Number: 4,780,995

[45] Date of Patent: Nov. 1, 1988

[54] FACIA ROOF EDGE SYSTEM AND METHOD

[76] Inventor: Charles E. Gittins, 3099 Wheeler Rd., Bay City, Mich. 48706

[21] Appl. No.: 37,936

[22] Filed: Apr. 13, 1987

[51] Int. Cl.[4] ..... E04D 1/36

[52] U.S. Cl. ..... 52/60; 52/96

[58] Field of Search ..... 52/96, 60, 58, 94

[56] References Cited

U.S. PATENT DOCUMENTS

| | | | |
|---|---|---|---|
| 4,071,987 | 2/1978 | Hickman | 52/94 |
| 4,155,203 | 5/1979 | Wolma | 52/60 |
| 4,241,549 | 12/1980 | Hall, III et al. | 52/60 |
| 4,403,458 | 9/1983 | Lolley | 52/60 |
| 4,419,850 | 12/1983 | Butzen | 52/60 |
| 4,439,956 | 4/1984 | House | 52/60 |
| 4,472,913 | 9/1984 | Hickman | 52/96 |
| 4,483,112 | 11/1984 | Rueblinger | 52/58 X |
| 4,549,376 | 10/1985 | Hickman | 52/60 X |
| 4,549,377 | 10/1985 | Castle | 52/94 |
| 4,598,507 | 7/1986 | Hickman | 52/94 |
| 4,641,476 | 2/1987 | Webb et al. | 52/60 |

*Primary Examiner*—Carl D. Friedman

*Attorney, Agent, or Firm*—Learman & McCulloch

[57] ABSTRACT

A flat roof cover system comprising a facia edge plate and a generally flat roof substructure which includes a nailable perimetral edge strip, and a waterproof rubber-like membrane cover of a length to extend beyond the edge strip. A rigid clip having a flat nailing portion is nailed to the upper face of the edge strip. The clip has a rigid inversely disposed V-shaped portion with a wall extending down along the building which terminates in a lock flange. A facia plate, having a like deformable resilient V-shaped portion terminating in a reversely turned edge bearing on said membrane edge and the clip plate gravel stop surface beneath it, has a latch socket to snap over said lock flange.

4 Claims, 1 Drawing Sheet

FACIA ROOF EDGE SYSTEM AND METHOD

FIELD OF THE INVENTION

This invention relates to roof edge systems, particularly for securing the edges of waterproof rubber roofing membranes in a manner to provide a gravel stop.

BACKGROUND OF THE INVENTION

In recent years the substructure of flat roofs, which formerly were covered with tar paper and asphalt, have been replaced by gravel-ballasted, waterproof, rubber membranes and the like, which are easier to install and more durable. Various edge systems, as exemplified in the following prior arts patents, have been proposed for fastening the membranes at the edges of the roof in a manner to avoid piercing the membrane edges, such that the membrane is rendered non-waterproof and subject to tear:

| | | | |
|---|---|---|---|
| 4,071,987 | Hickman | 4,439,956 | House |
| 4,155,203 | Wolma | 4,472,913 | Hickman |
| 4,241,549 | Hall et al | 4,483,112 | Rueblinger |
| 4,403,458 | Lolley | 4,549,376 | Hickman |
| 4,419,850 | Butzen | 4,549,377 | Castle |
| 4,598,507 | Hickman | | |

Particularly in some areas of the country, wind conditions are often extreme, and it is difficult to keep a membrane in place in view of the tremendous pressures which are generated when air pressures build up under the membrane and tend to lift the membrane, even when the membrane is severely ballasted. The prior art is replete with various prior art systems which have been proposed to solve the problem of securing the edges of the membrane in an attractive and inexpensive manner, without perforating the membrane. Because the edges of the membrane cannot be ballasted, and are subject to the same wind lift conditions, it is, normally the edges of the membrane which, in prior art systems, are torn loose initially by wind lift conditions.

SUMMARY OF THE INVENTION

The present system is directed to a composite water dam, facia edge, and membrane securing and sealing structure for a cover membrane which is ballasted by gravel intermediate its edges.

One of the prime objects of the present invention is to provide a system, which tests indicate solves the wind lift problems at the edges of the membrane without creating leakage problems in climates where there is considerable contraction and expansion of the membrane due to extreme temperature changes.

Another object of the invention is to provide a reliable membrane edge securing structure which avoids the use of the oft-proposed wood cant blocks, while still providing an attractive facia plate which can be snap-locked in position in an easy and economical manner.

Another object of the invention is to design a roof edge system for membranes of the character described, which provides the desired "give", permitting the structure to absorb wind shocks without being ripped loose.

The present invention utilizes a rigid clip plate, having a flat nailing portion secured to the upper face of an edge strip provided around the perimeter of the roof. The clip plate includes a vertically dependent portion, terminating in an angularly bent flange which functions to lock a deformable facia strip, having a socket for receiving the flange, in position. The angularity of the upwardly inclined, vertically spaced gravel stop portions of the clip and the facia strip is carefully maintained within a predetermined range, such that there is sufficient give in the facia strip-gravel stop portions to permit the system to deform without tearing loose. As in prior art systems, the roof membrane leads up over the gravel stop portions and down along the vertical face of the building structure between facia strip and clip plate.

Other objects and advantages of the invention will be pointed out specifically or will become apparent from the following description when it is considered in conjunction with the appended claims and the accompanying drawings.

IN THE DRAWINGS

FIG. 1 is a transverse, sectional, elevational view illustrating the edge lock system of the present invention, the chain lines indicating the undeformed position of the facia strip; and FIG. 2 is a fragmentary, face elevational view with portions broken away to disclose underlying elements.

DESCRIPTION OF A PREFERRED EMBODIMENT

Figure 1:
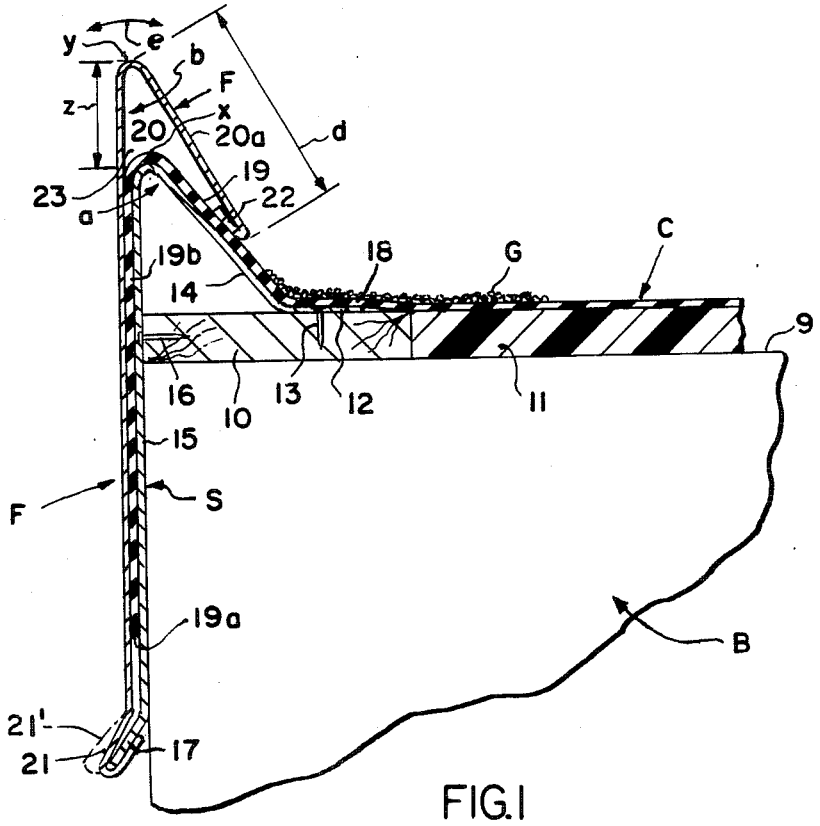
Figure 2:
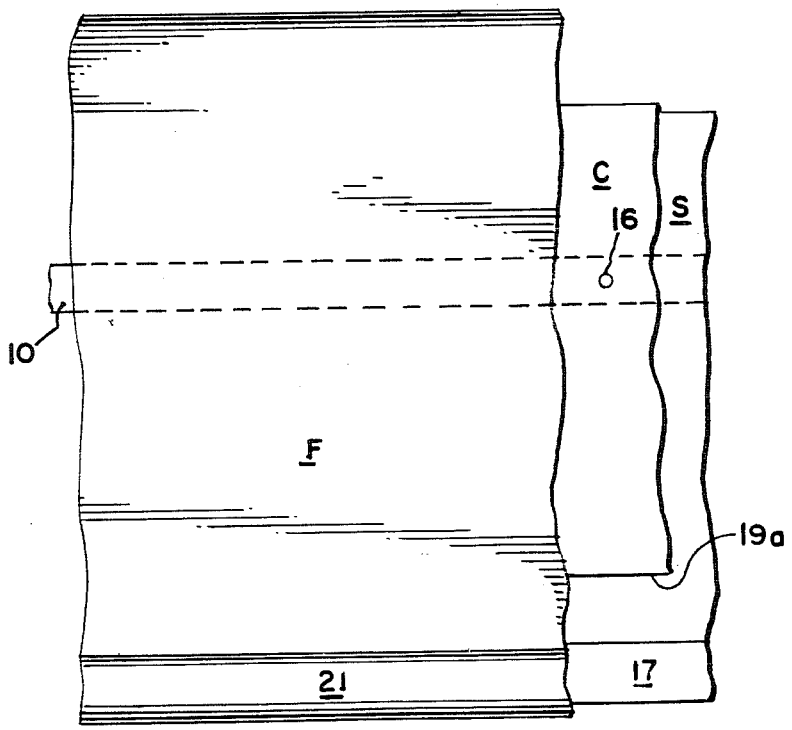

Referring now more particularly to the accompanying drawings, a building, generally designated B, is shown as having a flat upper deck surface 9, to which an edge strip of wood 10 is nailed, or otherwise suitably secured, around its perimeter. Insulation board 11 can be adhesively or otherwise secured on the deck surface 9 between the strips 10, and the roof can then comprise a rubber cover membrane C, covered with a suitable layer of gravel G as a ballast. To secure the edges of the covering C, without nailing through it, a rigid clip strip, generally designated S, is affixed in position around the perimetral edge of the building. It is provided with a horizontal flange 12, nailed in position to edge strip 10, as shown at 13. The nailing flange 12 connects with an upwardly and outwardly inclined, gravel stop section 14, which in turn, connects with a downwardly dependent section 15, nailed to the edge of the edge strip 10 as at 16. As shown, the strip S extends downwardly along the building wall below strip 10, and terminates substantially below the edge strip 10 in an outwardly and downwardly inclined tongue or flange 17.

Cover strip C is sufficiently flexible to extend over and conform to the configuration of the strip S, and, at its edges, includes a portion 18 which overlies nailing flange 12, a portion 19, which is brought upwardly over the bearing or gravel stop surface 14 of the clip S, and a vertical portion **19*b* which extends downwardly along the building structure, and terminates just above the flange 17 at 19*a*. The portion 19 is adhesively secured to the surface 14**.

The facia strip, generally designated F, which snap-locks to the rigid clip S, is of lesser gauge than the clip S, and has a predetermined flexibility which provides the necessary "give" to resist wind uplift forces, without becoming disengaged. It includes an outer vertical portion 20, terminating at its lower end in a socket 21, which snaps over tongue 17 and is held in place thereby. The vertical portion 20 extends a predetermined distance z above the apex x of the V-shaped portion a of the clip strip S formed by portions 14 and **19*b*. From its upper edge y, strip F folds down and has a bearing or gravel stop portion 21, forming with portion 20, a V-shaped portion b, which is spaced a predetermined distance above the V-shaped portion a. Portion 21 terminates in a reversely bent portion 22, which bears against the portion 19 of the membrane cover strip C, as indicated in FIG. 1**.

The facia strip F, when in the latched condition shown in FIG. 1, is deformed from its normal configuration (see the chain lines in FIG. 1) such that edge 22, over its length, exerts a clamping pressure against the portion 19 of the membrane strip C. In order to snaplock in position, the socket 21 must be deformed from the chain line position 21' shown in FIG. 1, to the solid line position shown.

To provide the necessary resistance to windlift and avoid the "popping off" which occurs in prior art installations, the angularity of the V-shaped portion b is held within the range of 20°–30°, and preferably is 25°.

The length of the portion 21, indicated by the d dimension, is held between $1\frac{3}{4}$ to 2 inches, and preferably is $1\frac{7}{8}$ inches in height. With this configuration, we have discovered that the facia strip F will not pop off under severe windlift conditions, as have prior art edge structures of a similar nature. Typically, the height of the portion 20 of the facia strip F, from the lower end of tongue 17 to the fold-over edge y, is then 5 inches. The strip F is necessary to hold the cover C on the roof in severe conditions even though adhesive is utilized between the portions 14 and 19.

The installation of the facia strip F is accomplished rather simply and economically. With the free edges of the membrane cover C folded back, the clip strips S are first nailed in position, as with nails 13 and 16, around the perimeter of the flat roof. Thereafter, the free edges of the membrane cover C are led up over the gravel stop portions 14 of the clip strips S, and are permitted to overlie the portions 19b of the clips S. It is then relatively easy to move a facia strip F from above, down to a position in which the flange 22 is in engagement with the gravel stop portion 19 of the membrane cover C, and the socket 21 is outward of, but opposite the tongue or flange 17. When socket 21 is deformed downwardly to accommodate the tongue 17 within the socket 21, clamping pressure is exerted over the length of the surface 22 against the portion 19 of the membrane cover C.

With the space 23 provided between the V-shaped portion a of the clip strip S, and the V-shaped portion b of the facia strip F, the V-shaped portion b can give or flex laterally in an arc e relative to the V-shaped portion a, without any loosening or popping off effect at latching socket 21. The flexing which occurs tends to do nothing other than increase the clamping pressure exerted by flange 22.

While one embodiment of the invention has been described in detail, it will be apparent to those skilled in the art that the disclosed embodiment may be modified. Therefore, the foregoing description in all aspects is to be considered exemplary rather than limiting in any way, and the true scope of the invention is that defined in the following claims.

What is claimed is:

1. In a facia edge structure for a generally flat roof comprising a roof substance which includes a nailable edge strip and a waterproof covering rubber-like membrane of a length to extend beyond the edge strip:

a. a rigid clip plate having a flat nailing portion adapted to be secured to the upper face of said edge strip; the clip having an upwardly and angularly outwardly extending gravel stop portion, with upper and lower ends, leading substantially linearly from the nailing portion to a downwardly extending portion leading downwardly relative to said gravel stop portion along the side surface of said edge strip and roof substructure from an upper edge spaced vertically above said edge strip to a position downwardly spaced substantially from said edge strip, the gravel stop portion and downwardly extending portion forming a rigid downwardly open V-shaped portion, and the clip plate downwardly extending portion terminating in a downwardly and outwardly extending lock flange;

b. the membrane leading up over the gravel stop portion and down along the side of said substructure; and c. a flexible facia plate having a vertically extending wall extending upwardly in juxtaposition to said downwardly extending portion of the clip plate from said flange to an upper edge spaced upwardly a substantial distance above the said upper edge of the downwardly extending portion of the clip plate, said facia plate having a downwardly and inwardly extending substantially linear gravel stop portion with upper and lower ends joined immediately to said upper edge of said vertically extending wall, forming a deformable resilient downwardly open V-shaped section with the vertically extending wall which is spaced vertically from said V-shaped portion of the clip and the membrane leading over it, and terminating in a reversely turned edge flange bearing directly on said membrane edge and the clip plate gravel stop surface beneath it interjacent the said ends of the gravel stop portion, the facia plate downwardly open V-shaped section providing an open space above said membrane extending upwardly from the reversely turned edge, there being a latch socket provided on the lower end of said facia plate to snap over said lock flange and retain said membrane edge without fastening it to said roof substructure, and the angle between said facia plate vertically extending wall and said facia plate membrane engaging portion being in the range of 20° to 30° to prevent windlift forces on the membrane from popping the facia strip out of installed position.

2. The invention defined in claim 1 wherein said membrane-engaging portion of the facia plate is between $1\frac{3}{4}$ and 2 inches in length from its lowermost edge to its uppermost edge.

3. The invention defined in claim 1 wherein said downwardly extending portion of the clip plate is nailed to the side surface of said edge strip.

4. A facia edge structure in combination with a generally flat roof, comprising a roof substructure which includes a nailable perimetral edge strip, and a waterproof, rubber-like cover membrane of a length to extend beyond the perimetral edge strip, the structure including:

a. a rigid clip having a generally flat nailing portion secured to the upper face of the edge strip;

b. the clip having an upwardly angularly outwardly inclined gravel stop portion leading substantially linearly at an obtuse angle upwardly from the nailing portion to immediately join to a downwardly extending portion leading along the side surface of said edge strip and roof substructure from the upper edge of the gravel stop portion to a position downwardly spaced from the edge strip, the gravel stop portion and downwardly extending portion forming a rigid downwardly open V-shaped section spaced above the roof substructure, and the lower portion of the downwardly extending portion of the clip having a lock component thereon;

c. the membrane leading up over the general stop portion down along the side of said substructure; and d. a flexible facia plate having a vertically extending wall extending upwardly in juxtaposition to said downwardly extending portion of the clip plate to an upper edge spaced upwardly a substantial distance from the said upper edge of the downwardly extending portion of the clip and membrane, said facia plate having a downwardly and inwardly extending substantially linear membrane engaging portion joined immediately to the upper edge of said vertically extending wall to form a resilient downwardly open V-shaped section with said vertically extending wall having an angularity in the 20–30 degree range and spaced vertically from said V-shaped section of the clip, said membrane engaging portion terminating in a reversely turned edge flange engaging and bearing on said memebrane and the unwardly and outwardly inclined clip gravel stop surface beneath it, the facia plate downwardly open V-shaped section providing an open space above said membrane extending upwardly from the reversely turned edge, and there being a lock component provided on the lower portion of the vertically extending wall of said facia plate interacting with said lock component on the clip.

* * * * *

UNITED STATES PATENT AND TRADEMARK OFFICE

CERTIFICATE OF CORRECTION

PATENT NO. : 4,780,995

DATED : November 1, 1988

INVENTOR(S) : Charles E. Gittins

It is certified that error appears in the above-identified patent and that said Letters Patent is hereby corrected as shown below:

Column 3, line 64, "substance" should be -- substructure --.

Column 5, line 8, "general" should be -- gravel --.

Column 6, line 9, "unwardly" should be -- upwardly --.

Signed and Sealed this

Twenty-fifth Day of April, 1989

*Attest:*

DONALD J. QUIGG

*Attesting Officer*

*Commissioner of Patents and Trademarks*